United States Patent [19]

Johansson et al.

[11] 4,041,989

[45] Aug. 16, 1977

[54] FORMING FABRIC AND A METHOD FOR ITS MANUFACTURE

[75] Inventors: Arne Boris Johansson, Halmstad; Francisco Lorente Codorniu, Aled, both of Sweden; Ingvald Strandly, Oslo, Norway

[73] Assignee: Nordiska Maskinfilt Aktiebolaget, Halmstad, Sweden

[21] Appl. No.: 618,067

[22] Filed: Sept. 30, 1975

[30] Foreign Application Priority Data

Oct. 10, 1974 Sweden ..... 7412722

[51] Int. Cl.[2] ..... D03D 15/00; D03D 15/02; B21F 1/10; B10D 39/08

[52] U.S. Cl. ..... 139/425 A; 139/413; 162/DIG. 1

[58] Field of Search ..... 139/425 A, 425 R, 383 A, 139/383, 408–413; 162/DIG. 1, 348, 349, 358; 245/8, 10; 74/231; 198/193; 34/95

[56] References Cited

U.S. PATENT DOCUMENTS

| | | | |
|---|---|---|---|
| 2,621,684 | 12/1952 | Love | 139/413 |
| 2,857,654 | 10/1958 | Sexton | 139/413 X |
| 2,903,021 | 9/1959 | Holden et al. | 139/425 A |
| 3,127,308 | 3/1964 | Justus et al. | 139/425 A |
| 3,473,576 | 10/1969 | Amneus | 139/425 A |
| 3,815,645 | 6/1974 | Codorniu | 139/383 A |
| 3,885,602 | 5/1975 | Slaughter | 139/425 A |
| 3,915,202 | 10/1975 | Curtis et al. | 139/425 A |

*Primary Examiner*—James Kee Chi

[57] ABSTRACT

A forming fabric for use in paper-making, cellulose or similar machines. The fabric comprising two layers of synthetic weft threads and synthetic warp threads. The latter interconnecting the weft thread layers but also binding separately the weft threads of the layer forming the paper making side of the fabric. The weft thread layer which forms the wear side of the fabric is tangent to a plane which is positioned outside the plane which is tangent to the warp threads interconnecting the weft layers.

16 Claims, 8 Drawing Figures

FORMING FABRIC AND A METHOD FOR ITS MANUFACTURE

BACKGROUND OF THE INVENTION

In paper-making and cellulose machines and machines for similar purposes single-layer metal screens and single or double layer fabrics woven from monofilaments or multifilaments are used in the sheet formation section. Metal screens are not very wear-resistant and are being replaced to an increasingly large extent by wires made from synthetic fibre threads, so called synthetic wires. Although synthetic fabrics are more durable than are metal screens there is a continuous effort to develop them further. Single-layer fabrics woven in three or four shaft patterns exhibit two surfaces that differ in pattern. On one of these surfaces the warp thread binds over two or three weft threads, respectively, whereas the warp thread binds below one weft thread only for each pattern repeat. This surface is usually called the warp side. The opposite surface is characterised in that the weft thread binds over two or three warp threads, respectively, whereas it passes beneath one warp thread only for each pattern repeat. This side is usually called the weft side. When single-layer syntethic wires began to replace the metal screens they were run in the same manner as metal screens, i.e. with the warp side facing inwards towards the abrasive elements of the paper machine. The warp thread, having more crimp was positioned further towards the two external planes of the fabric than was the case with the weft thread. Whichever way the fabric was turned, the warp yarn therefore was the one to be most exposed to wear. Because the warp side contains a larger quantity of warp yarn than does the weft side, it was natural to turn this side inwards towards the abrasive elements. In the case of flat woven and spliced wires, the warp yarn forms the longitudinally extending yarn and takes the entire wire tension whereas the weft yarn forms the crosswise yarn and is practically tensionless during the run in the paper machine. The wearing out of the warp yarn therefore is more limited than in the case of the weft yarn. By stretching the single-layer wire heavily while exposing it to a heat fixation treatment, the crimp may be shifted in such a manner that the warp thread is straightened while the weft thread takes on an increasing undulating configuration or curvature. Following a certain degree of stretching, the weft thread will form the wire surface (primarily on the weft side) whereas the warp thread, which is becoming more and more straight, will be positioned more towards the centre of the wire as seen in the cross-section thereof. When a fabric of this kind is run in the machine, the weft side is turned towards the abrasive elements. Consequently, primarily the weft threads will be exposed to wear. As these threads are practically completely relaxed, the wear may continue for a longer period of time before it becomes necessary to remove the wire from the machine.

In double-layer fabric (wire) structures comprising two layers of weft threads and warp threads interconnecting the layers the situation is different. The geometrical structure of the double-layer fabric hitherto used is such that no crimp or curvature shift corresponding to the one outlined above is possible as a result of stretching. An early type of double-layer forming fabric is characterised in that each warp thread binds in sequence between a first pair of weft threads above a second pair and a third pair, between the threads of a fourth pair and beneath the threads of a fifth pair and a sixth pair before the procedure is repeated. Upon stretching of the warp threads the contact pressure acted on the weft threads in a direction towards the fabric centre. As no counter-acting forces exerted a pressure in a direction outwards towards the fabric surface such stretching operations resulted in the weft threads being forced deeper inwards towards the fabric centre. The conditions are the same in the fabrics of the kind generally denominated paper makers dryer cloths. In this structure each warp thread in succession binds between a first pair of weft threads, above a second pair, between a third pair and beneath a fourth pair before the procedure is repeated.

The performance of the double-layer fabric is to a large extent dependent on the geometrical structure being such that the weft thread, upon stretching of the warp threads, will form the surface layer on both the surface facing the paper (the paper making side) and the one exposed to wear (the wear side). On the paper making side it is desirable that the threads of the two yarn systems will be positioned at essentially the same level, i.e. that their upper peripheral surfaces are tangents to the plane which forms the surface plane of the fabric side facing the paper web. On the wear side of the fabric it is desirable that the outer peripheral surface of the weft thread is positioned in a plane projecting somewhat beyond the plane forming the outer peripheral surface of the warp thread, i.e. that wire is new, its surface in contact with the abrasive elements of the paper machine (suction boxes, foils, and so on) is to be formed by weft threads.

In prior-art fabrics (wires) having this geometrical structure it is known that the layer of weft threads which in position of use is turned towards the material to be formed and the warp threads interconnecting these layers, are essentially tangents to the plane of the fabric (the outer plane) facing said material (Swedish Published Specification No. 366,353). The plane of the wire facing the dewatering elements of the paper machine (the inner plane) was earlier designed in such a manner that each warp thread bound beneath two successive pairs of weft threads. Because of this structural design it becomes impossible to achieve, by stretching the warp threads and partly straighten their crimp or curvature, a sufficiently high degree of further undulation of the layer of weft threads which faces the dewatering elements for these threads to be positioned beyond the plane formed by the peripheral surface of the warp threads. The Swedish Published Specification No. 366,353 does not describe any particular structural design for the part of the fabric facing the dewatering elements, and consequently the present invention must be considered as a further development of the invention disclosed in the publication referred to.

SUMMARY OF THE INVENTION

The present invention concerns a forming fabric for paper-making cellulose and similar machines of the kind comprising two layers of weft threads as well as warp threads which interconnect the two weft thread layers but also binds separately with the weft threads of the layer (upper layer) which in position of use of the fabric faces the material to be formed.

It is characteristic of the invention that the weft thread layer which faces the dewatering elements of the maching during position of use of the fabric is essentially tangent to a plane which is positioned beyond the plane which forms the tangent plane to the warp threads interconnecting the individual layers. Through this arrangement the weft threads will during position of use of the fabric, form the part of the fabric which contacts the dewatering elements and is exposed to wear therefrom.

The present invention likewise concerns a method of manufacturing forming fabrics of this kind. In the manufacture in accordance with the invention each warp thread is made to bind with at the most every sixth thread of the layer of weft threads which faces the machine dewatering elements in position of use of the fabric, in addition to which the warp threads are stretched in such a manner that the layer of weft threads which in position of use of the fabric faces the machine dewatering elements is tangent to a plane beyond the plane which is tangent to the warp threads interconnecting the individual layers. Because the above-mentioned interconnection points are thinly positioned and because each warp thread within the same pattern repeat only interconnects with one of the threads of said weft layer, said weft threads will take on an increasing curvature or undulating configuration as a result of stretching of the warp threads during heat fixation, the weft thread curvature being such that these threads will be tangents to a plane positioned beyond the plane which forms the tangent plane to the warp threads which interconnect the individual layers.

BRIEF DESCRIPTION OF THE DRAWINGS

The invention will be described more in detail in the following with reference to the accompanying diagrammatical drawings, wherein

FIG. 3 is a cross-sectional view through a forming fabric in unstretched condition in accordance with the present invention, whereas

DETAILED DESCRIPTION OF A PREFERRED EMBODIMENT

Figure 8:
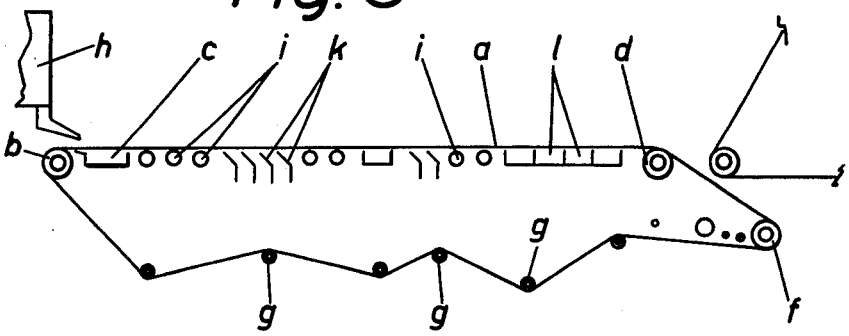
FIG. 8 illustrates in a schematic view the forming section of a paper-making machine.

FIG. 8 illustrates the manner in which an endless fabric *a* runs over a breast roll *b* a wire-frame *c* on which the sheet formation takes place, further onto a couch roll *d* and a nose roll *f* to return via a number of guide and stretching rollers *g* back to the head box *h* of the machine. In addition to being supported by the frame *c*, the fabric *a* is also supported by a number of tube (table) rolls *i*, a number a so-called foils *k* and suction boxes *l* acting as dewatering means for the paper web.

Figure 1:
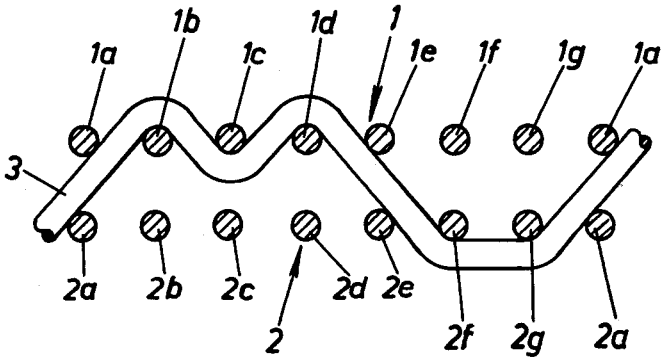
Fig. 1 PRIOR ART
FIG. 1 illustrates as an example a cross-sectional view through a forming fabric in unstretched condition.

The type of double-layer forming fabrics described in the Swedish Published Specification No. 366,353 comprises two layers 1, 2 of weft threads 1*a*, 1*b*, 1*c* and so on, 2*a*, 2*b*, 2*c*, and so on — one of the layers, layer 1, facing the material to be formed — as well as warp threads 3 which interconnect the individual weft layers and only one of which is illustrated in FIG. 1. The two weft thread layers 1, 2 form a pair wherein the threads are positioned substantially one above the other. The first warp thread (FIG. 1) binds between the first pair, above number two, between pair number three, above pair number four, between pair number five, beneath pairs number six and seven before the pattern is repeated. In addition the pattern comprises further six warp threads, not shown, wherein the binding procedure is displaced one to six weft thread pairs relative to the warp thread 3 illustrated in FIG. 1.

Figure 2:
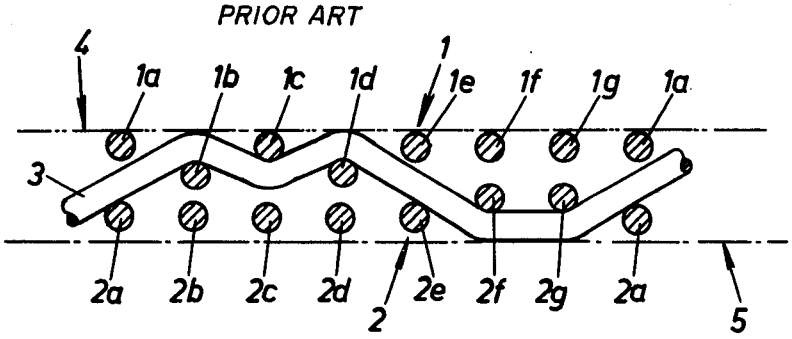
Fig. 2 PRIOR ART
FIG. 2 illustrates the same fabric in the stretched condition thereof.

When the fabric is exposed to tension during the heat fixation operation each warp thread 3 will be straightned as illustrated in FIG. 2. This straightening is to continue in accordance with the teachings of the Swedish Published Specification No. 366,353 until the weft threads 1*b* and 1*d* have been forced sufficiently far down for the warp thread knuckle, which is positioned above a weft thread, to be tangent to the same plane 4 as the rest of the weft threads 1*a*, 1*b*, 1*c*, 1*e*, 1*f*, and 1*g*. The latter weft threads are exposed to a corresponding pressing-down influence from the remaining six warp threads (not illustrated). As the area of contact of the warp thread 3 against the weft threads 1*b* and 1*d* exceeds the area of contact of the same warp thread against the weft threads 2*f* and 2*g* of weft layer 2, the latter threads will not be forced upwards to a corresponding degree. As a result, the warp thread 3 and the remaining warp threads will form the surface layer 5 facing the machine dewatering elements *i*, *k*, *l*, which is undesirable for reasons of wear.

Figure 3:
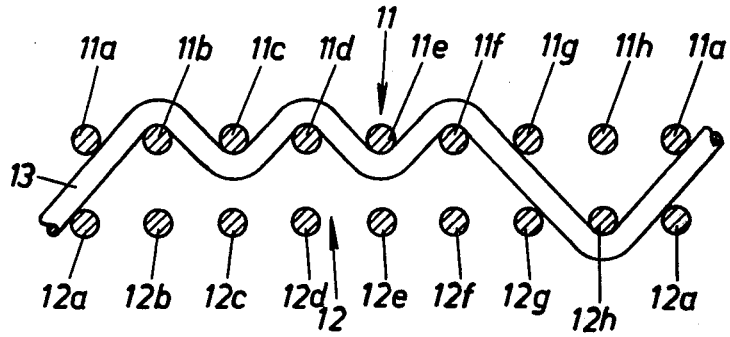

The unstretched fabric in accordance with FIG. 3 illustrates the basic structure of the fabric in accordance with the present invention. The structure consists as before of two layers 11, 12 of weft threads 11*a*, 11*b*, 11*c* and so on, 12*a*, 12*b*, 12*c*, and so on, of which one layer, layer 11, faces the material (the paper web) to be formed and the other layer 12 the machine dewatering elements - as well as warp threads 13 interconnecting the individual weft layers, only one such warp thread being illustrated in FIG. 3. The two layers 11, 12 of weft threads form a pair wherein the threads are positioned essentially one on top of the other. The warp thread 13 as illustrated binds between the frist pair of weft threads, above pair number two, between pair number three, above pair number four, between pair number five, above pair number six, between pair number seven and beneath pair number eight before repeat of pattern. In addition, the pattern comprises an additional seven warp threads, not shown, wherein the binding procedure has been displaced one to six weft thread pairs (although not necessarily in order) relative to the illustrated warp thread 13.

Figure 4:
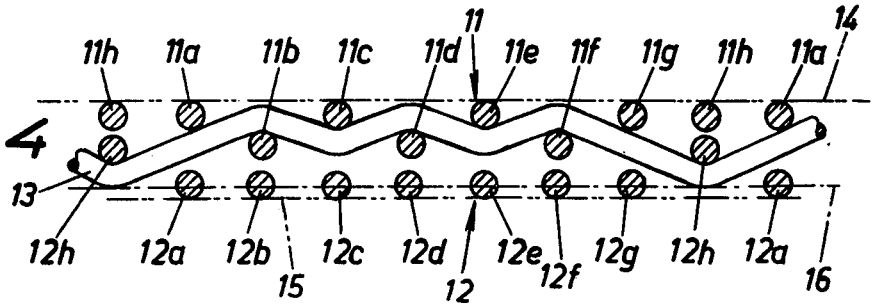
FIG. 4 illustrates the same fabric in stretched condition.

When the fabric in accordance with FIG. 3 is stretched in combination with heat treatment, each warp thread will be straightened as shown in FIG. 4. This straightening goes on in the same manner as in accordance with the Swedish Published Specification No. 366,353 until the weft threads 11*b*, 11*d*, and 11*f* have been forced down sufficiently for the warp knuckle positioned above a weft thread, to be tangent to the same plane 14 as the rest of the weft threads 11*a*, 11*c*, 11*e*, 11*g*, and 11*h*. The last-mentioned weft threads are forced downwards in a corresponding manner by the other seven warp threads (not illustrated). The area of contact of warp thread 13 is, in accordance with the novel structure, equally large against weft thread 12*h* as against threads 11*b*, 11*d*, and 11*f*. Consequently, weft thread 12*h* will be forced into the fabric just as easily as threads 11*b*, 11*d*, and 11*f*. In weft layer 12 each weft thread binds only with every eighth warp thread. The long float arising as a result hereof contributes to position the weft thread layer 12 so as to be tangent to a plane 15 which is positioned beyond the plane 16 which is the tangent plane of the warp threads interconnecting the weft layers.

The binding or interconnection points between the threads 12*a* to 12*h* of the weft layer 12 and the warp thread 13 as well as the other seven warp threads (not shown) are spaced eight threads apart both in the cross-wire and longitudinal directions of the fabric. One has found that a spacing of at least six threads, — i.e. each warp thread binds together with at the most every sixth thread in the layer or weft threads which faces the machine dewatering elements in position of use of the fabric — is necessary to obtain the prescribed difference between planes 15 and 16 (FIG. 4).

The structure as shown and illustrated in FIGS. 3 and 4 is to be regarded as an example only and consequently other types of patterns are possible. A number of such patterns are shown in FIGS. 5 to 7.

Figure 5:
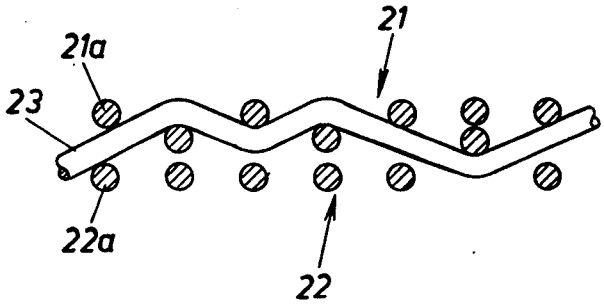
FIG. 5 through 7 illustrate similar cross-sectional views through fabrics in accordance with the present invention but using different weaving patterns.

In accordance with FIG. 5 warp thread 23 binds between the weft threads of the first pair, i.e. thread 21*a* of layer 21 and thread 22*a* of layer 22, above pair number two, between pair number three, above pair number four, between pair number five, beneath pair number six before the procedure is repeated.

Figure 6:
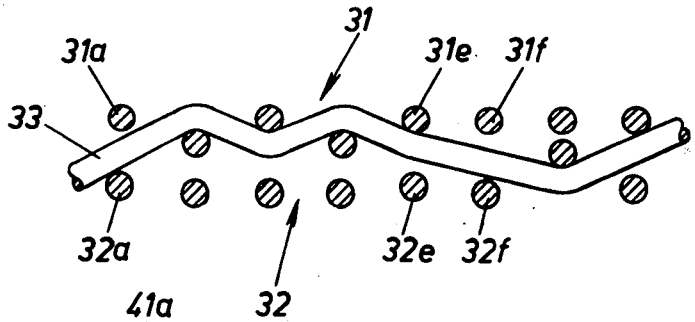

In accordance with FIG. 6 the warp thread 33 binds between the weft threads of the first pair, i.e. thread 31*a* of layer 31 and thread 32*a* of layer 32, above pair number two, between pair number three, above pair number four, between pairs number five and six, beneath pair number seven, before the procedure is repeated. As appears from the illustration there is a certain irregularity in that the warp thread is led upwards between one pair of weft threads 31*a* and 32*a* but is led downwards between the pairs of weft threads 31*e* and 32*e*, and 31*f*. This type of structure may be varied by letting the warp thread bind between two weft threads only in its downwards passage (FIG. 6) or only in its upwards passage or both in its upwards and downwards passages. Furtermore, the warp threads may bind between two weft thread pairs alternatingly in upwards and downwards passage.

Figure 7:
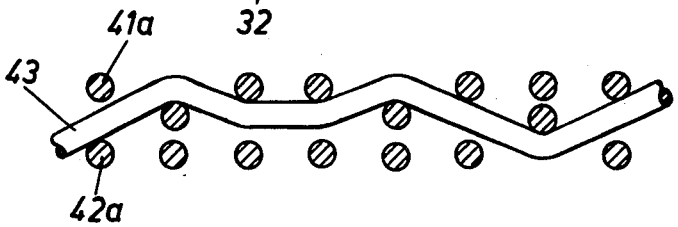

In accordance with FIG. 7 warp thread 43 binds between the weft threads of the first pair, i.e. thread 41*a* of layer 41 and thread 42*a* of layer 42 above pair number two, between pairs number three and four above pair number five, between pair number six, beneath pair number seven before the procedure is repeated.

The illustrations should be regarded as schematical and naturally the stretching of a warp thread may influence the position of the weft thread in the neighbouring cross-section through the weave such that the weft threads which are not influenced by one of the illustrated warp threads may be spread in different planes, depending on the influence from neighbouring warp threads.

The material of the fabric preferably consists of synthetic monofilament threads and/or multifilament threads. The latter may be stiffend through chemical treatments.

What we claim is:

1. An improved method of manufacturing forming fabrics intended for use in paper-making, cellulose or similar machines including the steps of providing two layers of synthetic weft threads and synthetic warp threads, said warp threads interconnecting said weft thread layers and additionally binding separately with the weft threads of the upper layer which, during the position of use of said fabric faces the material to be formed, and including the further improvement of arranging each one of said warp threads in such a manner that it binds with at the most every sixth thread of the layer of weft threads which in position of use of said fabric faces the dewatering elements of said machine, and stretching said warp threads so as to make said second weft thread layer which in the position of use of said fabric faces said machine dewatering elements tangent to a first plane positioned outside a second plane, said second plane being tangent to said warp threads interconnecting said weft layers.

2. An improved method as claimed in claim 1, comprising arranging said two layers of weft threads so as to form a pair to position said threads of each pair essentially one on top of the other, each warp thread binding in sequence between a first pair of weft threads, above a second pair of weft threads, between a third pair of weft threads, above a fourth pair of weft threads, between a fifth pair of weft threads, above a sixth pair of weft threads, between a seventh pair and beneath an eight pair of weft threads before the procedure is repeated.

3. An improved method as claimed in claim 1, comprising arranging said two layers of weft threads so as to form a pair to position said threads of each pair essentially one on top of the other, each warp thread binding in sequence between a first pair of weft threads, above a second pair of weft threads, between a third pair of weft threads, above a fourth pair of weft threads, between a fifth pair and beneath a sixth pair of weft threads before the procedure is repeated.

4. An improved method as claimed in claim 1, comprising arranging said two layers of weft threads so as to form a pair to position said threads of each pair essentially one on top of the other, each warp thread binding in sequence between a first pair of weft threads, above a second pair of weft threads, between a third pair of weft threads, above a fourth pair of weft threads, between a fifth pair and a sixth of weft threads, and beneath a seventh pair of weft threads before the procedure is repeated.

5. An improved method as claimed in claim 1 comprising arranging said two layers of weft threads so as to form a pair to position said threads of each pair essentially one on top of the other, each warp thread binding in sequence between two pairs of weft threads, above a third pair of weft threads, between a fourth pair of weft threads, above a fifth pair of weft threads, between a sixth pair of weft threads and beneath a seventh pair of weft threads before the procedure is repeated.

6. An improved method as claimed in claim 1, comprising arranging said two layers of weft threads so as to form a pair to position said threads of each pair essentially one on top of the other, each warp thread binding in sequence between two pairs of weft threads, above a third pair of weft threads, between a fourth pair of weft threads, above a fifth pair of weft threads, between a sixth pair and a seventh pair of weft threads and beneath an eighth pair of weft threads before the procedure is repeated.

7. An improved method as claim in claim 1, comprising arranging said two layers of weft threads so as to form a pair to position said threads of each pair essentially one on top of the other, every first one of said warp threads binding in sequence between a first pair of weft threads, above a second pair of weft threads between a third pair of weft threads, above a fourth pair of weft threads, between a fifth pair and a sixth pair of weft threads, and beneath a seventh pair of weft threads whereas every other one of said warp threads binds in sequence between two pairs of weft threads, above a third pair of weft threads, between a fourth pair of weft threads, above a fifth pair of weft threads, between a sixth pair of weft threads and beneath a seventh pair of weft threads before the procedure is repeated.

8. An improved method as claimed in claim 1, comprising arranging said two layers of weft threads so as to form a pair to position said threads of each pair essentially one on top of the other, each warp thread binding in sequence between a first pair of weft threads, above a second pair of weft threads, between a third pair and a fourth pair of weft threads above a fifth pair of weft threadsm, between a sixth pair of weft threads and beneath a seventh pair of weft threads before the procedure is repeated.

9. An improved method as claimed in claim 1, comprising stretching said warp threads in any known manner while keeping said weft threads relaxed.

10. An improved forming fabric comprising first and second layers of synthetic weft threads and a layer of synthetic warp threads interconnecting said weft thread layers anf additionally binding separately with the weft threads of said first layer which during the position of use of said fabric faces the material to be formed, the improvement comprising said second weft thread layer which faces the machine dewatering element during position of use of said fabric, being tangent to a first plane positioned outside a second plane, said second plane being tangent to said warp threads interconnecting said weft layers, and said weft threads forming pairs, each warp thread binding in sequence between a first pair of weft threads, above a second pair of weft threads, between a third pair of weft threads, above a fourth pair of weft threads, between a fifth pair of weft threads, above a sixth pair of weft threads, between a seventh pair and beneath an eighth pair of weft threads before the procedure is repeated.

11. An improved forming fabric comprising first and second layers of synthetic weft threads and a layer of synthetic warp threads interconnecting said weft thread layers and additionally binding separately with the weft threads of said first layer which during the position of use of said fabric faces the material to be formed, the improvement comprising said second weft thread layer which faces the machine dewatering element during position of use of said fabric, being tangent to a first plane positioned outside a second plane, said second plane being tangent to said warp threads interconnecting said weft layers, and said weft threads forming pairs, each warp thread binding in sequence between a first pair of weft threads, above a second pair of weft threads, between a third pair of weft threads, above a fourth pair of weft threads, between a fifth pair and beneath a sixth pair of weft threads before the procedure is repeated.

12. An improved forming fabric comprising first and second layers of synthetic weft threads and a layer of synthetic warp threads interconnecting said weft thread layers and additionally binding separately with the weft threads of said first layer which during the position of use of said fabric faces the material to be formed, the improvement comprising said second thread layer which faces the machine dewatering element during position of use of said fabric, being tangent to a first plane positioned outside a second plane, said second plane being tangent to said warp threads interconnecting said weft layers, and said weft threads forming pairs, each warp thread binding in sequence between a first pair of weft threads, above a second pair of weft threads, between a third pair of weft threads, above a fourth pair of weft threads, between a fifth pair and a sixth pair of weft threads, and beneath a seventh pair of weft threads before the procedure is repeated.

13. An improved forming fabric comprising first and second layers of synthetic weft threads and a layer of synthetic warp threads interconnecting said weft thread layers and additionally binding separately with the weft threads of said first layer which during the position of use of said fabric faces the material to be formed, the improvement comprising said second thread layer which faces the machine dewatering element during position of use of said fabric, being tangent to a first plane positioned outside a second plane, said second plane being tangent to said warp threads interconnecting said weft planes, and said weft threads forming pairs, each warp thread binding in sequence between two pairs of weft threads, above a third pair of weft threads, between a fourth pair of weft threads, above a fifth pair of weft threads, between a sixth pair of weft threads and beneath a seventh pair of weft threads before the procedure is repeated.

14. An improved forming fabric comprising first and second layers of synthetic weft threads and a layer of synthetic warp threads interconnecting said weft thread layers and additionally binding separately with the weft threads of said first layer which during the position of use of said fabric faces the material to be formed, the improvement comprising said second thread layer which faces the machine dewatering element during position of use of said fabric, being tangent to a first plane positioned outside a second plane, said second plane being tangent to said warp threads interconnecting said weft layers, and said weft threads forming pairs, each warp thread binding in sequence between two pairs of weft threads, above a third pair of weft threads, between a fourth pair of weft threads, above a fifth pair of weft threads, between a sixth pair and a seventh pair of weft threads and beneath an eighth pair of weft threads before the procedure is repeated.

15. An improved forming fabric comprising first and second layers of synthetic weft threads and a layer of synthetic warp threads interconnecting said weft thread layers and additionally binding separately with the weft threads of said first layer which during the position of use of said fabric faces the material to be formed, the improvement comprising said second weft thread layer which faces the machine dewatering element during position of use of said fabric, being tangent to a first plane positioned outside a second plane, said second plane being tangent to said warp threads interconnecting said weft layers, and said weft threads forming pairs, each warp thread binding in sequence between a first pair of weft threads, above a second pair of weft threads, between a third pair of weft threads, above a fourth pair of weft threads, between a fifth pair and a sixth pair of weft threads, and beneath a seventh pair of weft threads whereas every other one of said warp threads binds in sequence between two pairs of weft threads, above a third pair of weft threads, between a fourth pair of weft threads, above a fifth pair of weft threads, between a sixth pair of weft threads and beneath a seventh pair of weft threads before the procedure is repeated.

16. An improved forming fabric comprising first and second layers of synthetic weft threads and a layer of synthetic warp threads interconnecting said weft thread layers and additionally binding separately with the weft threads of said first layer which during the position of use of said fabric faces the material to be formed, the improvement comprising said second weft thread layer which faces the machine dewatering element during position of use of said fabric, being tangent to a first plane positioned outside a second plane, said second plane being tangent to said warp threads interconnecting said weft layers, and said weft threads forming pairs, each warp thread binding in sequence between a first pair of weft threads, above a second pair of weft threads, between a third pair and a fourth pair of weft threads, above a fifth pair of weft threads, between a sixth pair of weft threads and beneath a seventh pair of weft threads before the procedure is repeated.

* * * * *